United States Patent [19]

Lauzier

[11] Patent Number: 4,673,017

[45] Date of Patent: Jun. 16, 1987

[54] ADJUSTABLE MOUNT FOR ROLLER-TYPE AWNING

[75] Inventor: René Lauzier, Isere, France

[73] Assignee: Etablissements Lauzier, Bourgoin Jallieu, France

[21] Appl. No.: 837,503

[22] Filed: Mar. 7, 1986

[30] Foreign Application Priority Data

Mar. 12, 1985 [FR] France ..... 85 04057

[51] Int. Cl.[4] ..... E04F 10/06

[52] U.S. Cl. ..... 160/22; 160/66; 248/273

[58] Field of Search ..... 160/66, 69, 68, 70, 160/22, 42; 248/273, 269, 270, 271, 272, 274; 135/89; 242/68.7, 73.5

[56] References Cited

U.S. PATENT DOCUMENTS

| | | | |
|---|---|---|---|
| 1,054,131 | 2/1913 | Mealy | 248/270 X |
| 1,833,688 | 11/1931 | Nelson et al. | 160/22 |
| 2,085,227 | 6/1937 | Norman | 248/274 |
| 2,740,470 | 4/1956 | D'Azzo | 160/22 |
| 3,782,443 | 1/1974 | Clauss et al. | 160/22 |
| 3,991,805 | 11/1976 | Clauss | 160/22 |
| 4,093,139 | 6/1978 | Amoretti | 242/68.7 X |
| 4,469,159 | 9/1984 | Lohausen | 160/22 |
| 4,566,516 | 1/1986 | Lohausen | 160/22 |

FOREIGN PATENT DOCUMENTS

| | | | |
|---|---|---|---|
| 880321 | 10/1961 | United Kingdom | 160/66 |
| 1409816 | 10/1975 | United Kingdom | 135/89 |

*Primary Examiner*—Ramon S. Britts
*Assistant Examiner*—David M. Purol
*Attorney, Agent, or Firm*—Karl F. Ross; Herbert Dubno

[57] ABSTRACT

An awning has a flexible awning panel having generally parallel upper and lower edges, an elongated winder secured to the upper edge and extending along and rotatable about a longitudinally extending winder axis, and a stabilizer bar secured to the lower edge. Respective longitudinally spaced hinged arms have outer ends secured to the stabilizer bar and inner ends. At least one mounting bracket adapted to be secured to a wall or ceiling surface is formed with two transversely spaced and longitudinally extending bracket pivots. At least one respective support engaged around the winder to support same is formed with a plurality of transversely spaced and longitudinally extending support pivots. Two links each having one end pivoted on the bracket at a respective one of the bracket pivots and another end pivoted on the support at a respective one of the support pivots form two opposite sides of a parallelogrammatic-type linkage and the support and bracket forming the other two opposite sides thereof. A retaining unit is engageable between the support and bracket for relatively displacing same between a multiplicity of positions angularly offset relative to each other relative to the winder axis and for locking the support and bracket against relative movement in any of the positions.

14 Claims, 7 Drawing Figures

ADJUSTABLE MOUNT FOR ROLLER-TYPE AWNING

FIELD OF THE INVENTION

The present invention relates to a roller-type awning, that is an awning that is wound up around a shaft when it is pulled up. More particularly this invention concerns hardware for mounting such an awning on a vertical wall and/or horizontal ceiling surface.

BACKGROUND OF THE INVENTION

A standard roller-type awning of the type described in French patent No. 2,311,170 has a flexible awning panel, which may be formed by canvas or by a multiplicity of articulated horizontal slats and which has an upper edge attached to a winder core and a lower edge attached to a stabilizer bar. The winder core is a shaft that is typically associated with mechanism so that it can be rotated in either direction, normally carrying at one end a gear meshing with a worm that can be rotated by a manual crank or by a motor. The bar, which serves to keep the lower awning edge straight and to weigh down the awning, is typically secured at its ends to respective arms that have upper ends pivoted on supports adjacent the winder shaft and lower ends pivoted about parallel axes on the ends of the stabilizer bar. These arms have central pivots permitting them to bend about axes parallel to the axes of their ends, and are normally spring loaded into the straight position.

Thus when such an awning is lowered the weight of the stabilizer bar and the springs of the arms pull out the blind and straighten out the arms. When the awning is wound up the arms bend back until their two halves extend virtually parallel to each other and normally also parallel to the stabilizer bar and until the stabilizer bar lies virtually on the rolled-up awning panel.

Obviously such a piece of equipment is fairly bulky. It is typically held in an elongated housing that is generally of C-section, forming a slot through which the panel projects. The winder shaft floats in this housing whose inner diameter is sufficient to accommodate the wound-up awning. Right- and left-hand end fittings are provided to secure the housing to a wall or ceiling, and typically different types of fittings are used, depending on whether the awning is to be wall or ceiling mounted. The orientation of the housing is particularly important since when the awning is extended it should not rub on the housing, otherwise with time the awning will wear through at this location.

As a result the mounting of such an awning is a fairly complex process. First of all the awning and housing must be cut to length. Then the appropriate wall- or ceiling-mount end fittings are selected, different ones for each end, and installed on the cut housing. The entire assembly is then hoisted into place and secured at the ends. This procedure is onerous in the extreme and adds considerably to the cost of such an awning.

OBJECTS OF THE INVENTION

It is therefore an object of the present invention to provide an improved roller awning.

Another object is the provision of such a roller awning which overcomes the above-given disadvantages, that is which is easy to mount and inexpensive to manufacture.

SUMMARY OF THE INVENTION

An awning according to the invention has a flexible awning panel having generally parallel upper and lower edges, an elongated winder secured to the upper edge and extending along and rotatable about a longitudinally extending winder axis, and a stabilizer bar secured to the lower edge. Respective longitudinally spaced hinged arms have outer ends secured to the stabilizer bar and inner ends. At least one mounting bracket adapted to be secured to a wall or ceiling surface is formed with two transversely spaced and longitudinally extending bracket pivots. At least one respective support engaged around the winder to support same is formed with a plurality of transversely spaced and longitudinally extending support pivots. Two links each having one end pivoted on the bracket at a respective one of the bracket pivots and another end pivoted on the support at a respective one of the support pivots form two opposite sides of a parallelogrammatic-type linkage and the support and bracket forming the other two opposite sides thereof. A retaining unit is engageable between the support and bracket for relatively displacing same between a multiplicity of positions angularly offset relative to each other relative to the winder axis and for locking the support and bracket against relative movement in any of the positions.

The parallelogrammatic-type linkage, that is a linkage formed by four rigid links forming a quadrilateral and interconnected at parallel pivots at the corners of the quadrilateral, is extremely strong and at the same time can be deformed to provide a wide range of relative movement between the support and the bracket. The pivots can all be formed by simple strong pins capable of supporting substantial weight and no great pains need be taken to hold them in place since the forces they support are normally perpendicular to themselves, that is in a direction not tending to move them out of their gudgeons or eyes.

The system of this invention can therefore be quite simple, and can allow the awning to be ceiling and/or wall mounted using the same mounting assembly principally formed by the support, bracket, and links. The relatively light brackets can first be secured, and they do not both have to be mounted on the same surface, and then the heavier awning assembly moved into position and hung, after which the retaining unit is used to get the exact position desired.

According to this invention the support has a pair of C-shaped and longitudinally spaced and aligned flanges flanking the respective link ends. These flanges are each formed with at least three holes forming the respective support pivots and longitudinally aligned with the holes of the respective flange. The support pivots also are formed by respective support-pivot pins engaged in the longitudinally aligned holes. Typically each flange is formed with four such holes, two for one of the links and two for the other link.

The retaining unit of this invention includes a screw having an inner end rotatably mounted but otherwise fixed in the bracket and an outer end threaded in one of the pins. The outer end of the link pivoted on the one pin in which the screw is threaded is forked and centrally receives the screw. This is an extremely compact assembly capable of stepless adjustment of the angular position of the housing. This screw can be generally upright so it can work against the weight of the assembly for easiest adjustment.

In accordance with another feature of this invention there are two such brackets, supports, first and second links, and retaining units spaced longitudinally along the axis. In addition each holder has a first arm seat formed on the support and defining a pivot axis transverse of the winder axis, a slot extending longitudinally on the support and open transversely toward the pivot, a slide longitudinally displaceable in the slot and having a second seat alignable transversely with the first seat, and means for securing the slide in place in the slot. Each arm is provided at its inner end with a fitting fitted into the seats of the respective holder and slide and pivotal therein about a respective transverse axis. Furthermore each slide is formed with a with a transversely open threaded bore and with a transverse projection in turn formed with a longitudinally open bore. A screw threaded into the transverse bore bears transversely on the support to hold the slide in place on the support and an adjustment screw threaded into the longitudinal bore and bears longitudinally on the support. This makes it possible to accurately adjust the inner pivot of the articulated awning arms to ensure that they tuck up out of the way when the awning is closed. So that the support can be used at either end of the awning, that is so that both supports are identical, each support is formed with two such first seats spaced longitudinally apart. These second seats are positionable aligned transversely with either of the respective first seats.

According to a further feature of this invention the awning and its winder axle are received in a C-section housing surrounding the winder and formed with a longitudinal mouth through which the panel extends. Two such supports are secured to and longitudinally spaced along the housing, although others not having the hardware for the inner arm end could be used between the awning ends in a very long system.

DESCRIPTION OF THE DRAWING

The above and other features and advantages will become more readily apparent from the following, reference being made to the accompanying drawing in which.

SPECIFIC DESCRIPTION

Figure 1:
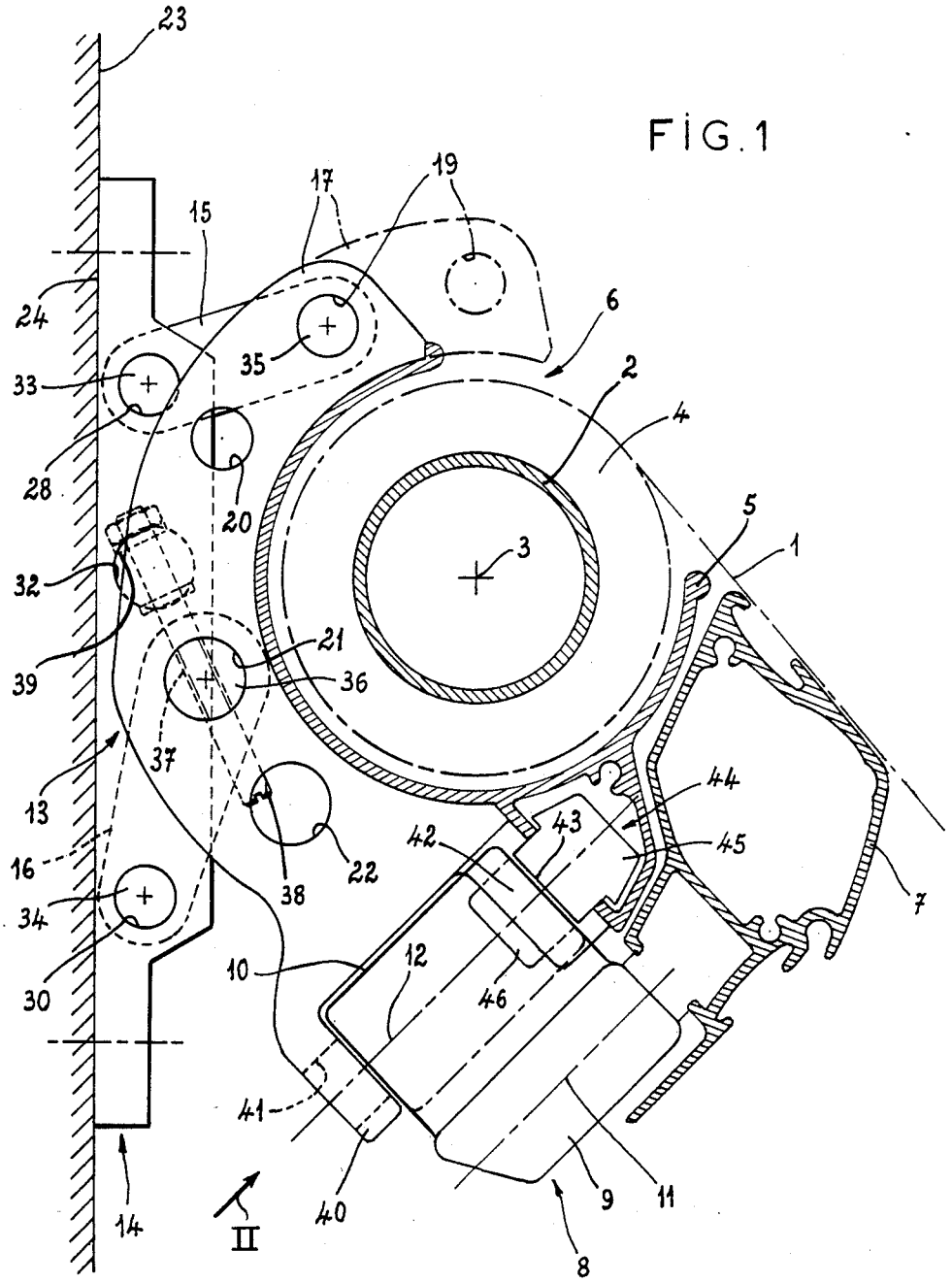
FIG. 1 is a cross section through the awning according to this invention.

As seen in FIG. 1 an awning basically comprises a panel 1 having a lower edge fixed in a stabilizer weight bar 7 and an upper end wound in a coil 4 around a shaft 2 centered on a longitudinal winder axis 3 in a C-section housing 5 extending longitudinally along the axis 3 and having a transversely open but longitudinally extending mouth 6 through which the panel 1 extends. At each longitudinal end of the housing 5 is a support or holder 13 forming a transverse lower pivot axis 12 for one part 10 of a bendable arm 8 whose other part 9 is pivoted about another transverse axis 11 on the respective end of the bar 7. These two arm parts 9 and 10 can pivot on their axes 11 and 12 between positions extending generally straight between them when the awning 1 is down to the illustrated positions in which the two parts 9 and 10 extend generally parallel to each other with their elbow joint longitudinally inward.

Figure 2:
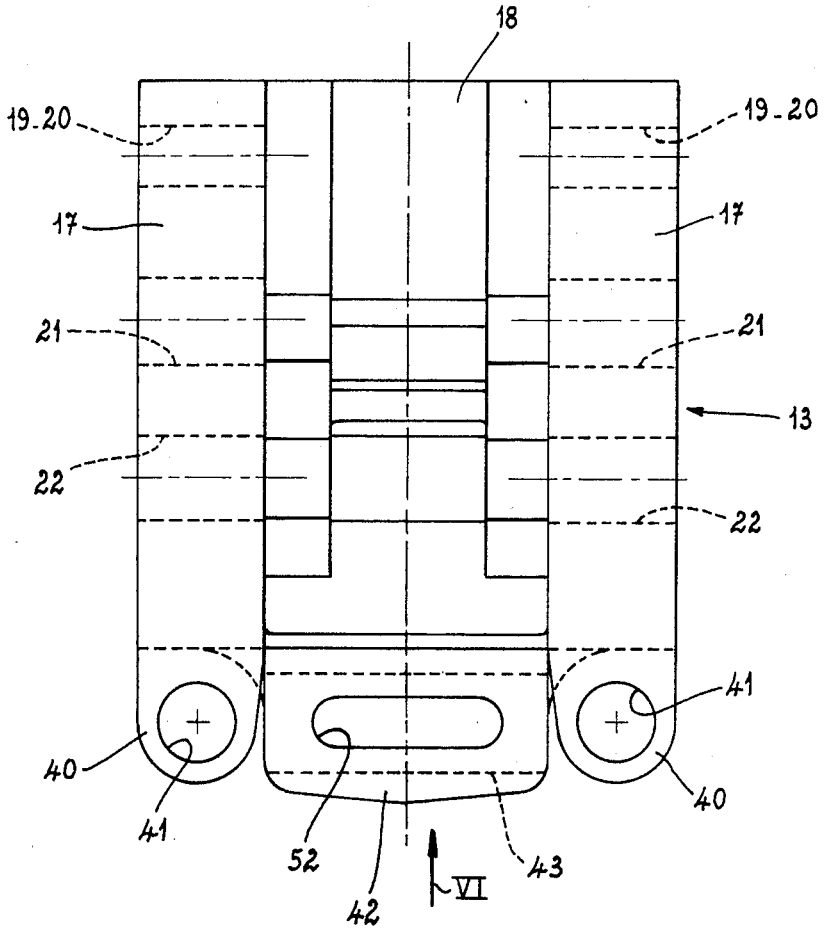
FIG. 2 is a view taken in the direction of arrow II of FIG. 1 of the holder or support for the awning of this invention.

According to the present invention each holder 13 is itself carried on a respective bracket 14 mounted on a ceiling or wall surface 23 by a pair of rigid bar links 15 and 16. To this end the holder 13 as best seen in FIG. 2 is formed with a pair of flanges 17 defining a space 18 in which the upper and lower links 15 and 16 and part of the respective bracket 14 are received. These flanges 17 are C-shaped and are each formed with four holes 19, 20, 21, and 22 spaced angularly about and spaced equally radially from the axis 3.

Figure 3:
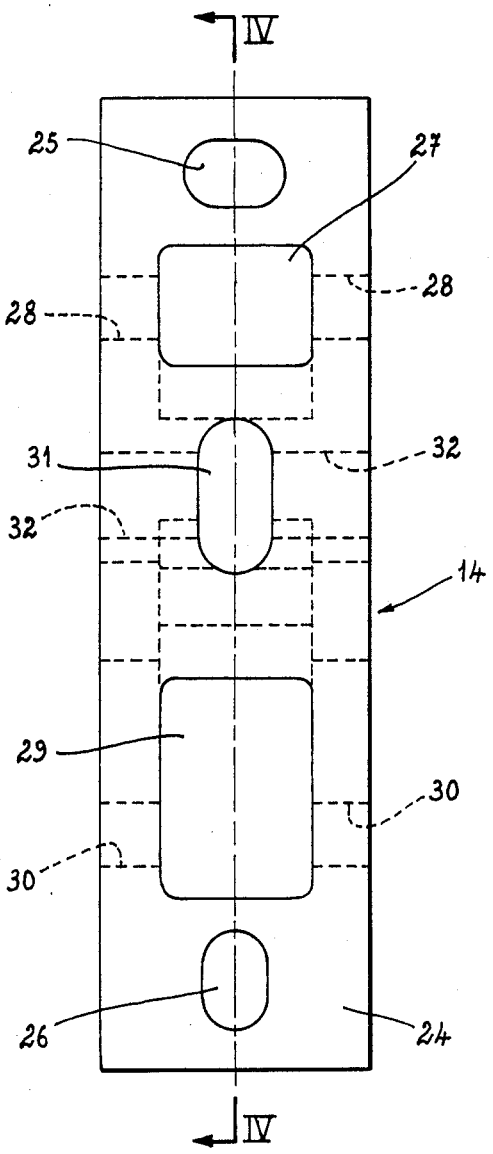
FIG. 3 is a front view of the mounting bracket for the holder of this invention.
Figure 4:
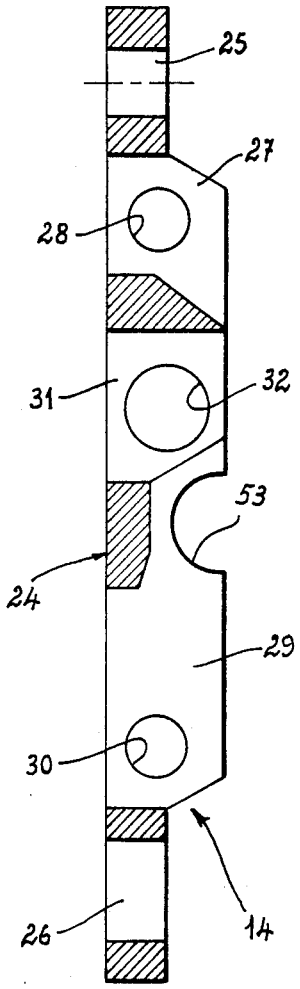
FIG. 4 is a section taken along line IV—IV of FIG. 3.

The bracket 14 as seen in FIGS. 3 and 4 has a planar rear surface 24 lying flatly on the wall surface 23 and is formed at its ends with holes 25 and 26 permitting it to be bolted solidly in place. In addition it is formed with a horizontally throughgoing upper cutout 27 into which two coaxial horizontal bores 28 open, a central cutout 31 into which two coaxial bores 32 open, and a lower cutout 29 into which two lower coaxial bores 30 open. Its front face is also formed slightly below the middle cutout 31 with an outwardly open notch 53.

The upper link 15 has an inner end projecting into the cutout 27 and secured therein by a pivot pin 33 and an outer end lying between the flanges 17 and secured in the bore 19 (or in the bore 20 as indicated by the dashed-line position of FIG. 1) by another such pin 35. Similarly the lower link has an inner end projecting into the cutout 29 and secured therein by a pivot pin 34 and an outer end lying between the flanges 17 and secured in the bore 21 (or in the bore 22 in the dashed-line position) by a pin 36.

The two links 15 and 16 therefore constitute upper and lower links of a parallelogrammatic-type linkage, and the holder 13 and bracket 14 form the other two links. With this arrangement it is therefore possible to rock the entire housing 5 generally about its axis.

Figure 5:
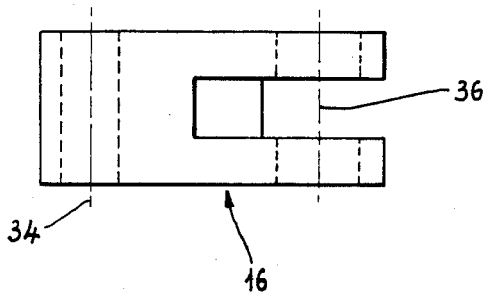
FIG. 5 is an elevational view of the lower link of this invention.

As best illustrated in FIG. 5 the outer end of this link 16 is forked. The pivot pin 36 is formed with a transverse threaded bore 37 (FIG. 1) and a screw 38 is threaded into this bore 37 and has an inner end that is rotatable but otherwise fixed in a pin 39 carried in the central bores 32. This screw 38 can therefore be rotated to establish and fix the angular orientation of the housing 5.

Figure 6:
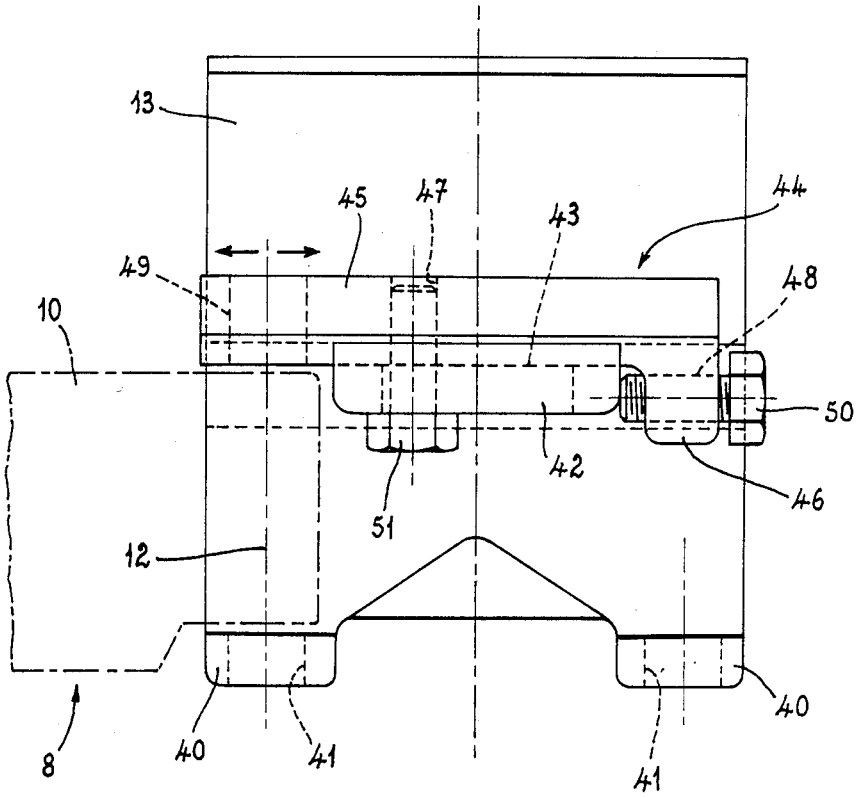
FIG. 6 is a view taken in the direction of arrow VI of FIG. 2.
Figure 7:
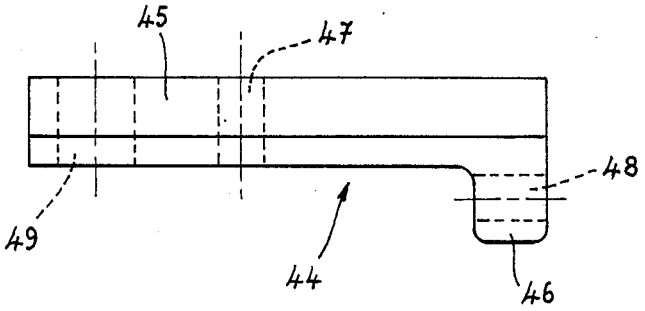
FIG. 7 is a elevational view of the slide of the awning of the invention.

FIGS. 6 and 7 illustrate how the axis 12 is defined by a pair of cylindrical seats 41 and 49. The support 13 has two tabs 40 defining two such seats 41 at its opposite longitudinal ends. A slide 44 defines the other seat 49 and is longitudinally displaceable in a longitudinal slot 43 that is open transversely away from the seats 40 and that is formed by a central laterally projecting tab 42 of the housing 13. The slide 44 itself has a main bar part 45 sliding in the groove 43, formed at one end with the seat 49, and provided at the other end with a lateral projection 46 formed with a longitudinally throughgoing bore 48 aligned with the tab 42. This tab 42 itself is formed with a transversely throughgoing and longitudinally elongated slot 52 and the bar 45 is formed with a transversely throughgoing threaded bore 47 exposed in the slot 43. Respective screws 50 and 51 are engaged in the bores 48 and 47, the former bearing axially on the longitudinal end of the tab 42 opposite the seat 49 and the latter bearing on the tab 42. These screws 50 and 51 therefore respectively longitudinally position and fix the slide 44 on the tab 42 of the housing 5.

An awning as described above is installed as follows:

First of all the awning 1, stabilizer bar 7, housing 5, and tube shaft 2 are cut to the desired length. One end of the housing 5 is closed by an end cap that may provide a pivot for the shaft 4 and the other end with another cap that includes the winding mechanism that rotates this shaft 2 about the axis 3. Then one support 13 is secured to each end of the housing 5. One arm 8 has its outer end secured at the axis 11 to the corresponding end of the bar 7 and its opposite end fitted into the innermost of the two seats 41. The slide 44 is then mounted in the slot 43, with its seat 49 aligned with the other seat 41 being used and fitting over the other end of the pivot pin of the inner arm part 10, and the screw 51 is snugged.

The brackets 14 are secured to the wall or ceiling surfaces at locations spaced apart by the distance between the supports 13. The exact vertical or horizontal positions of the brackets 14 are not extremely critical and one can be even somewhat out of longitudinal alignment with the other in some cases. The links 15 and 16 are then mounted on the brackets 14 by the pins 33 and 34.

The assembly of awning 1, bar 7, arms 8, and holders 5 is then hoisted into place and roughly positioned so that when the awning is down it will pass tangentially out the opening 6 without rubbing on the housing 5, and the outer ends of the links 15 and 16 are secured in whichever of the holes 19–21 they can be aligned with by insertion of the pins 35 and 36. Meanwhile the pins 39 are mounted and the screws 38 screwed through the pins 36 and anchored in the pins 39. The arms 8 are then extended and the screws 38 are rotated to angularly position the housing 5 to feed the awning 1 as desired out the center of the mouth 4.

The screws 50 serve to adjust the positions of the arms 8 so they do not stick akimbo out of the awning in the closed position.

The system of this invention therefore allows a single relatively simple support and bracket system to serve at either end of the awning and allow for all types of mounting on vertical, horizontal, or even inclined surfaces. The system is fully adjustable during and after installation and yet is very strong, with all principal forces being withstood principally as tension or shear by the various parts.

I claim:

1. An awning comprising:

a flexible awning panel having generally parallel upper and lower edges;

an elongated winder secured to the upper edge and extending along and rotatable about a longitudinally extending winder axis;

a stabilizer bar secured to the lower edge;

respective longitudinally spaced hinged arms having outer ends secured to the stabilizer bar and inner ends;

at least one mounting bracket adapted to be secured to a surface and formed with two transversely spaced and longitudinally extending bracket pivots;

at least one respective support engaged around the winder and supporting same and formed with a plurality of transversely spaced and longitudinally extending support pivots;

two links each having one end pivoted on the bracket at a respective one of the bracket pivots and another end pivoted on the support at a respective one of the support pivots, the links forming two opposite sides of a four-sided linkage and the support and bracket forming the other two opposite sides thereof; and retaining means including a screw braced between the support and bracket and rotatable for relatively displacing same through positions angularly offset relative to each other relative to the winder axis and for locking the support and bracket against relative movement in any of the positions.

2. The awning defined in claim 1 wherein the support has a pair of C-shaped and longitudinally spaced and aligned flanges flanking the respective link ends.

3. The awning defined in claim 2 wherein the flanges are each formed with at least three holes forming the respective support pivots and longitudinally aligned with the holes of the respective flange, the support pivots also being formed by respective support-pivot pins engaged in the longitudinally aligned holes.

4. The awning defined in claim 3 wherein each flange is formed with four such holes, two for one of the links and two for the other link.

5. The awning defined in claim 3 wherein the screw has an inner end rotatably mounted but otherwise fixed in the bracket and an outer threaded in one of the pins.

6. The awning defined in claim 5 wherein the outer end of the link pivoted on the one pin in which the screw is threaded is forked and centrally receives the screw.

7. The awning defined in claim 1 wherein there are two such brackets, supports, first and second links, and retaining means spaced longitudinally along the axis, each support having a first arm seat formed on the support and defining a pivot axis transverse of the winder axis;

a slot extending longitudinally on the support and open transversely toward the pivot;

a slide longitudinally displaceable in the slot and having a second seat alignable transversely with the first seat; and means for securing the slide in place in the slot, each arm being provided at its inner end with a fitting fitted into the seats of the respective holder and slide and pivotal therein about a respective transverse axis.

8. The awning defined in claim 7 wherein each slide is formed with a with a transversely open threaded bore and with a transverse projection in turn formed with a longitudinally open bore, the slide-securing means being a screw threaded into the transverse bore and bearing transversely on the support and an adjustment screw threaded into the longitudinal bore and bearing longitudinally on the support.

9. The awning defined in claim 7 wherein each support is formed with two such first seats spaced longitudinally apart, the second seat being positionable aligned transversely with either of the respective first seats.

10. The awning defined in claim 1, further comprising a C-section housing surrounding the winder and formed with a longitudinal mouth through which the panel extends, there being two such supports secured to and longitudinally spaced along the housing.

11. An awning comprising:

a C-section and longitudinally extending housing formed with a longitudinally extending but transversely open mouth;

a flexible awning panel having generally parallel upper and lower edges;

an elongated winder secured to the upper edge and extending along and rotatable about a longitudinally extending winder axis within the housing, the panel extending out of the housing through the mouth thereof;

a stabilizer bar secured to the lower edge;

respective longitudinally spaced hinged arms having outer ends secured to the stabilizer bar and longitudinally spaced inner ends;

two longitudinally spaced mounting brackets secured to a surface and each formed with two transversely spaced and longitudinally extending bracket pivots;

two respective longitudinally spaced supports engaged around the housing and supporting same and each formed with at least three transversely spaced and longitudinally extending support pivots, the inner arm ends being pivoted on the respective supports;

two respective pairs of links each having one end pivoted on the respective bracket at a respective one of the bracket pivots and another end pivoted on the respective support at a respective one of the support pivots, each pair of links forming two opposite sides of a four-sided linkage and the respective support and bracket forming the other two opposite sides thereof; and respective retaining means including respective screws braced between the supports and the respective brackets for relatively displacing same through positions angularly offset relative to each other relative to the winder axis and for locking the supports and brackets against relative movement in any of the positions.

12. The awning defined in claim 11 wherein each holder has a first arm seat formed on the support and defining a pivot axis transverse of the winder axis;

a slot extending longitudinally on the support and open transversely toward the pivot;

a slide longitudinally displaceable in the slot and having a second seat alignable transversely with the first seat; and means for securing the slide in place in the slot, each arm being provided at its inner end with a fitting fitted into the seats of the respective support and slide and pivotal therein about a respective transverse axis.

13. The awning defined in claim 12 wherein each slide is formed with a transversely open threaded bore and with a transverse projection in turn formed with a longitudinally open bore, the slide-securing means being a screw threaded into the transverse bore and bearing transversely on the support and an adjustment screw threaded into the longitudinal bore and bearing longitudinally on the support.

14. The awning defined in claim 12 wherein each support is formed with two such first seats spaced longitudinally apart, the second seat being positionable aligned transversely with either of the respective first seats.

* * * * *